US007893330B1

(12) United States Patent
Andreasen

(10) Patent No.: US 7,893,330 B1
(45) Date of Patent: Feb. 22, 2011

(54) STRINGED INSTRUMENT CONSTRUCTION

(76) Inventor: Randy G. Andreasen, 525 Blackberry Dr., Austin, TX (US) 78745

( * ) Notice: Subject to any disclaimer, the term of this patent is extended or adjusted under 35 U.S.C. 154(b) by 0 days.

(21) Appl. No.: 12/545,416

(22) Filed: Aug. 21, 2009

Related U.S. Application Data

(60) Provisional application No. 61/094,672, filed on Sep. 5, 2008.

(51) Int. Cl.
*G10D 3/00* (2006.01)

(52) U.S. Cl. ..... 84/291

(58) Field of Classification Search ..... 84/267, 84/291, 293
See application file for complete search history.

(56) References Cited

U.S. PATENT DOCUMENTS 3,911,778 A 10/1975 Martin
5,911,168 A 6/1999 Enserink
5,945,614 A 8/1999 White
6,114,616 A 9/2000 Naylor
6,372,970 B1 4/2002 Saunders, Jr. et al.
6,809,245 B2 10/2004 Sawhney et al.
7,183,473 B2 2/2007 Untermyer et al.
7,449,624 B2 11/2008 Boute
2003/0145712 A1 8/2003 Steinberger
2009/0013848 A1 * 1/2009 Farnell, Jr. ..... 84/291

* cited by examiner

*Primary Examiner*—Kimberly R Lockett
(74) *Attorney, Agent, or Firm*—Fitch, Even, Tabin & Flannery

(57) ABSTRACT

An ergonomic guitar wherein the plane of the strings is shifted toward the player as a result of its overall construction. It includes a guitar body having a center spine region in the form of an open-top channel. The guitar neck is advantageously fitted and clamped to the bottom wall of the channel in a manner which assures maximum sustain and tonal quality of the instrument.

18 Claims, 5 Drawing Sheets

Fig. 2
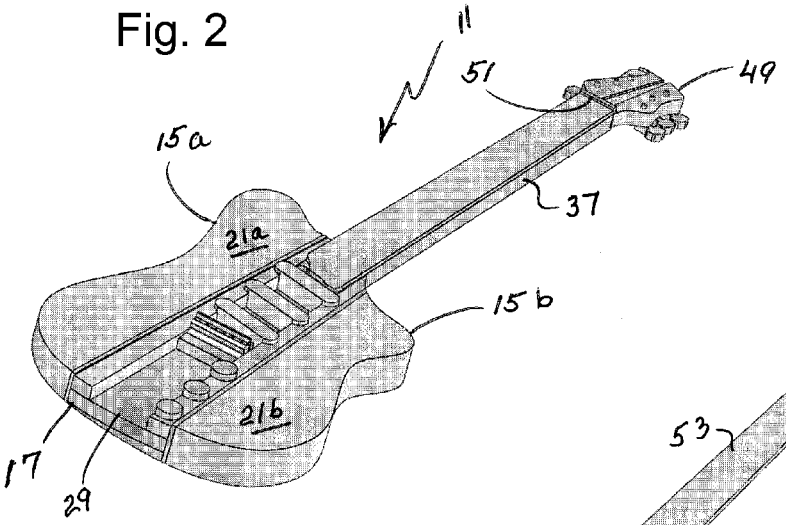
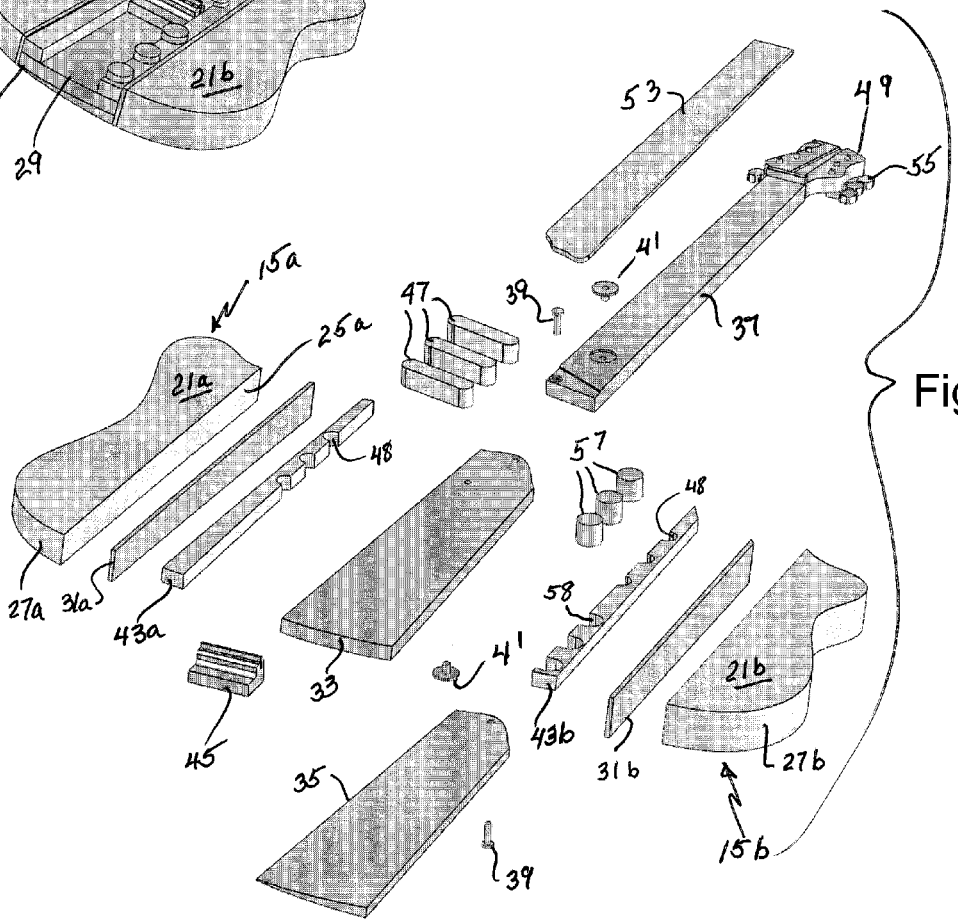
Fig. 3

STRINGED INSTRUMENT CONSTRUCTION

CROSS REFERENCE TO RELATED APPLICATION

This application claims priority from U.S. Provisional Application No. 61/094,672, filed Sep. 5, 2008.

FIELD OF THE INVENTION

The invention relates to the construction of stringed instruments and more particularly to the construction of guitars. It is felt to have particular application to the construction of bodies for guitars and more particularly to electric guitars.

BACKGROUND OF THE INVENTION

Guitars and other stringed instruments of a wide variety of designs have been made for decades, and many have been the subject of U.S. patents. U.S. Pat. Nos. 3,991,778; 5,911,168; 6,114,616; 6,809,245; 7,183,473 and 7,449,624 are examples of just a few of such patents. In the past decade or so, more attention has been given to ergonomics, i.e. the science of designing equipment to particularly fit a user or worker, and ergonomic designs have become of increasingly greater interest.

SUMMARY OF THE INVENTION

The invention provides a stringed instrument of ergonomic design which embodies a unique guitar body assembly upon which a neck and bridge are mounted. The structurally unique body design is ergonomic, and it is also of such a construction that overcomes volume/sustain tone and other deficiencies of prior art instruments. The design is such that it is constructed in right-handed (RH) and left-handed (LH) versions, and the construction is such that it shifts the plane of the strings towards the face of the player. The joinder of the neck to the body and the provision of an open center channel in the guitar body result in an improved arrangement which allows for maximum sustain and volume because the joinder of the neck to the body in such an environment is such that there is no compromising of sound volume or tonal potential.

In one particular aspect, there is provided an electric guitar which comprises a body having an upper end and a lower end and which is assembled from a center spine and a pair of wings, each wing having a top wall, a bottom wall, a sidewall and a peripheral wall, and each said wing being affixed at its respective inner wall to said center spine so as to flank same on opposite lateral sides thereof, and a neck attached to said body and extending longitudinally therefrom, said wings comprising a proximal wing that will reside adjacent the body of the player and a distal wing, and said proximal wing having a height that is less than the height of said distal wing as a part of an overall construction that shifts the plane of strings that extend along said neck toward the face of the player.

In another particular aspect, there is provided A guitar which comprises a body and a neck extending longitudinally from an upper end of said body, said body having a flat bottom wall and a top wall that includes (a) a proximal section which would lie closer to the person playing the guitar and (b) a distal section lying beyond said proximal section, said proximal section of said top wall lying in a plane oriented at an angle at least about 4 degrees to the plane of said distal section, and said neck having a top surface that is essentially parallel to the proximal section of said top wall so that the plane of strings that will extend longitudinally along said neck is shifted toward the face of the player.

In a further particular aspect, there is provided a guitar which comprises a body, a neck extending longitudinally from an upper end of the body to a headstock at the end thereof, said body having a bottom surface, a peripheral surface and a top surface, which top surface has a planar distal region and a planar proximal region which is oriented at an angle of about 4 to 7 degrees to said distal surface region, and said neck having a top planar surface that is essentially parallel with said planar proximal region, and means for supporting a plurality of strings, which all extend longitudinally along said neck from a central region of said body, so that the supported strings lie in a plane essentially parallel to said proximal surface region, which plane is shifted toward the face of the player.

BRIEF DESCRIPTION OF THE DRAWINGS

FIG. 2 is another perspective view of the instrument shown in FIG. 1 with the strings omitted.

FIG. 3 is an exploded perspective view of the instrument shown in FIG. 2.

DETAILED DESCRIPTION OF THE PREFERRED EMBODIMENTS

Figure 1:
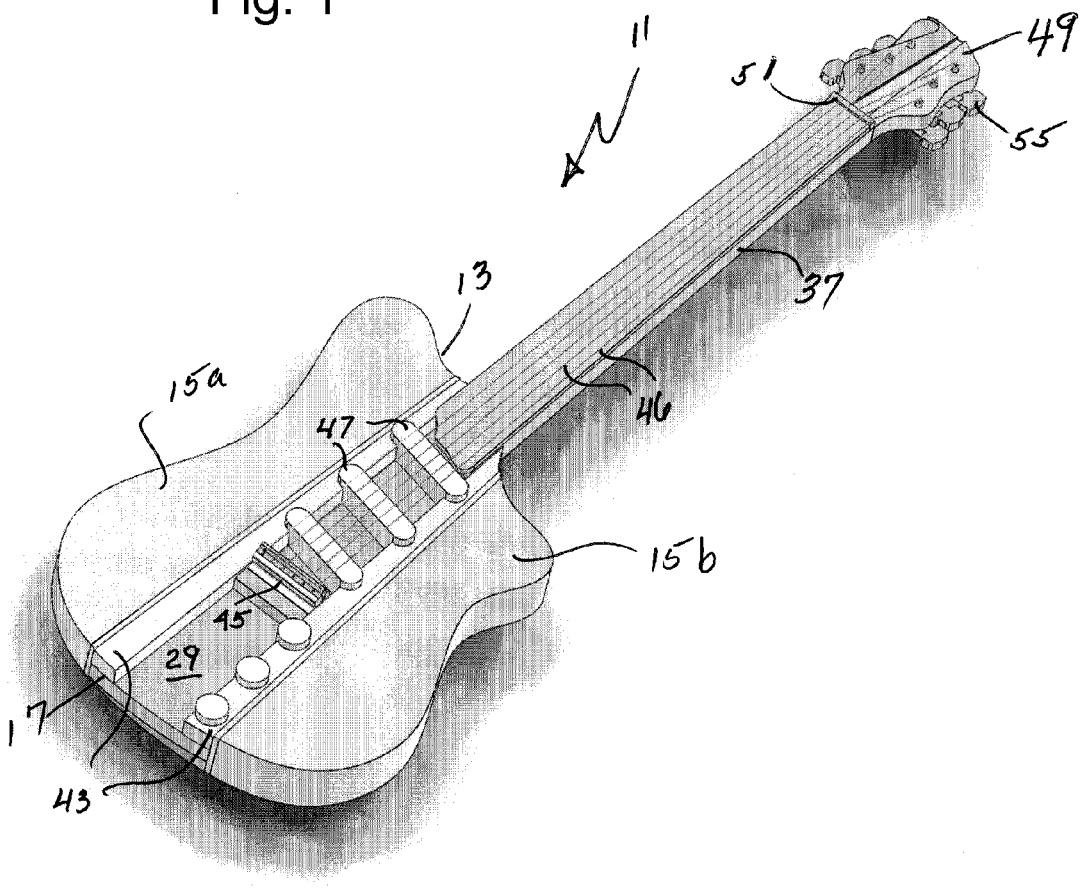
FIG. 1 is a perspective view of a stringed instrument embodying various features of the invention.

The invention is applicable to various types of stringed instruments that are played by strumming with one hand while the other grasps the neck of the instrument. Illustrated in the drawings is a guitar 11 having a body 13 which is formed by a proximal wing 15*a* and a distal wing 15*b* that are affixed to a center spine 17. For an electric guitar, these wings 15 may both be made of solid material, and they are suitably affixed, as by use of a strong adhesive, to lateral sidewalls of the structure that constitutes the center spine 17 of the body. Accordingly each of the pair of wings 15 will have a top wall 21, a bottom wall 23, a sidewall 25, which is attached to the center spine and a peripheral wall 27. The construction of these components is such as to produce an arrangement that shifts the plane of the strings, that will extend along a neck of the instrument, toward the face of the player as a result of the proximal wing 15*a* having a top surface 21*a* that is canted toward the player.

The preferred construction of the center spine 17 is best seen in FIGS. 3, 4, 6 and 7. The center spine 17 has the form of an open channel that has a bottom 29 and two lateral walls 31, i.e. 31*a* and *b*. The bottom 29 is a composite of two components: an internal bottom member 33 of constant thickness and an external bottom member 35 of varying thickness, i.e. wedge-shaped in cross section being thickest along its distal edge; the upper surface of the lower external bottom member 35 is oriented at about the same angle to its flat bottom surface as that at which the top wall 21*a* is oriented to that bottom wall 23*a* of the proximal wing 15*a*. Thus, in the final assembled guitar 11, the interior surface of the bottom 29 of the center spine channel is essentially parallel to the top surface 21*a* of the proximal wing. By essentially parallel is meant within about 1 or 2 degrees of precisely parallel.

Figure 4:
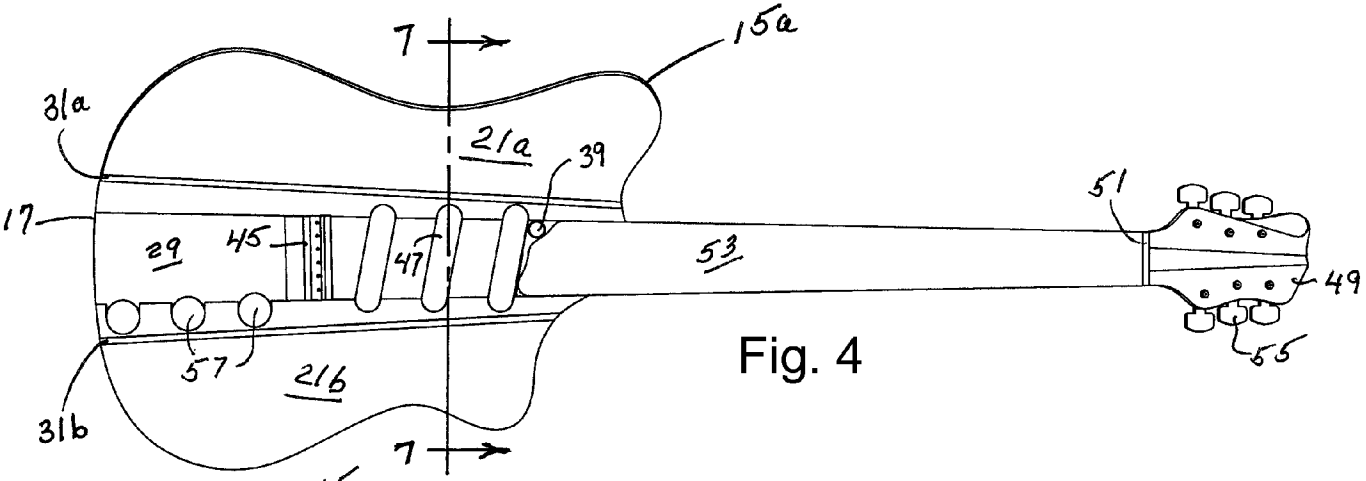
FIG. 4 is a top or plan view of the instrument shown in FIG. 2.
Figure 5:
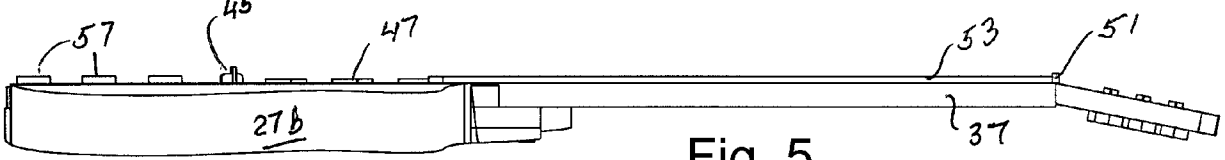
FIG. 5 is a right side view of the instrument shown in FIG. 2.
Figure 7:
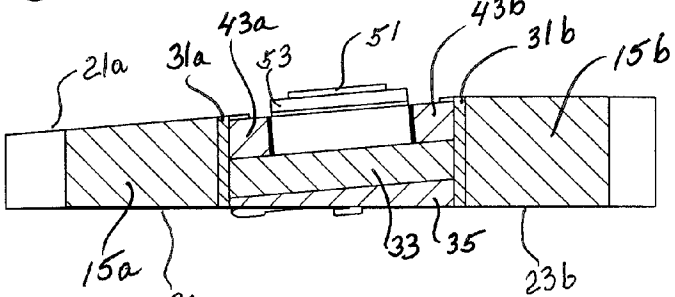
FIG. 7 is a cross-sectional view, enlarged in size, taken along the line 7-7 of FIG. 4, with the pickups omitted.

Although the two lateral walls 31 could be oriented so they are parallel and a composite bottom member might have parallel lateral side edges, preferably there is some divergence of the lateral spine walls 31 from the upper end to the lower end of the body, as seen in FIGS. 1 and 4. As a result, the center spine 17 increases in width from the upper end of the body 13 to the lower end of the body in a preferred embodiment. To reinforce the center spine 17, a pair of ribs 43, i.e. 43*a* and 43*b*, are suitably affixed, as by strong adhesive attachment, to both the upper surface of the composite bottom 29 and the interior surfaces of the lateral walls 31 (see FIG. 7). The height of the ribs 43 may be such as to extend to and be flush with the upper edge surfaces of the lateral spine walls 31, or the ribs 43 may terminate short thereof so as to be recessed therebelow, in which case decorative edging may be added.

Figure 8:
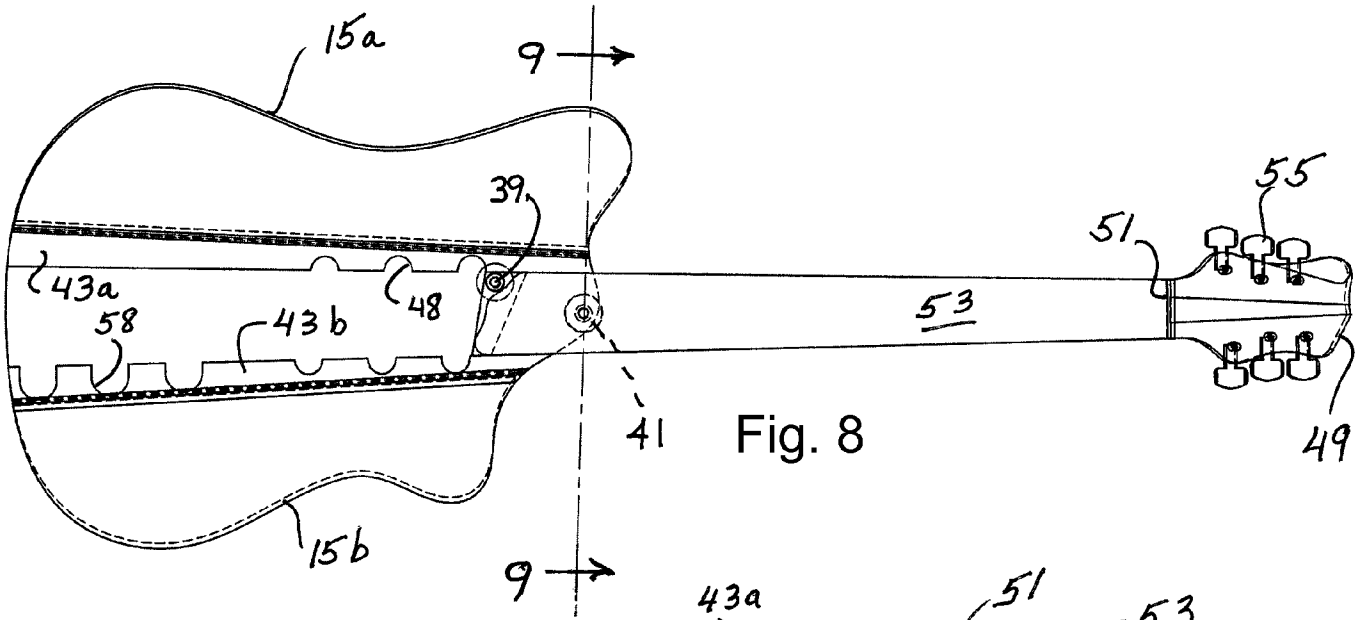
FIG. 8 is a plan view similar to FIG. 4 with some components removed.
Figure 9:
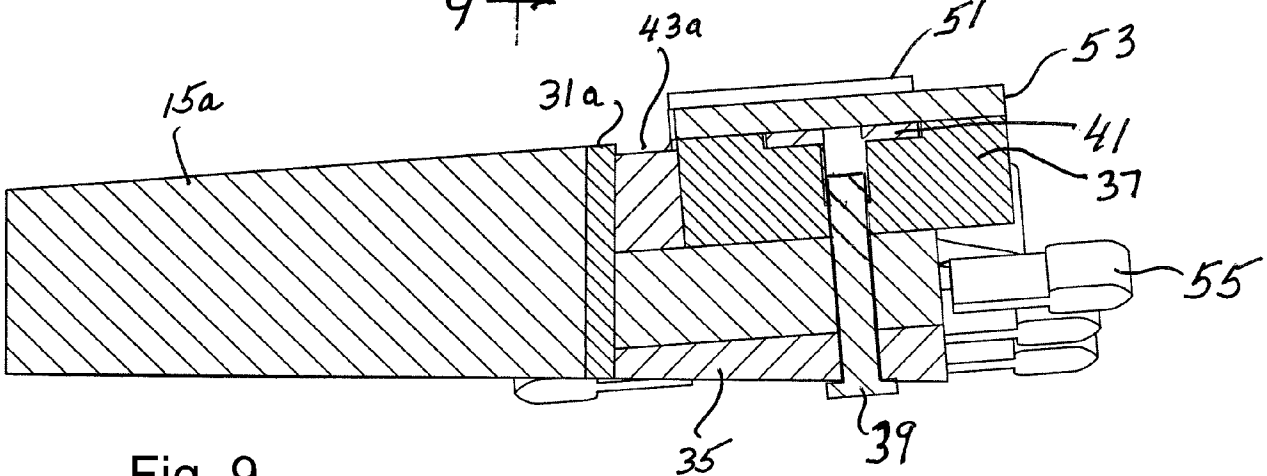
FIG. 9 is a cross-sectional view, enlarged in size, taken along the line 9-9 of FIG. 8.
Figure 10:
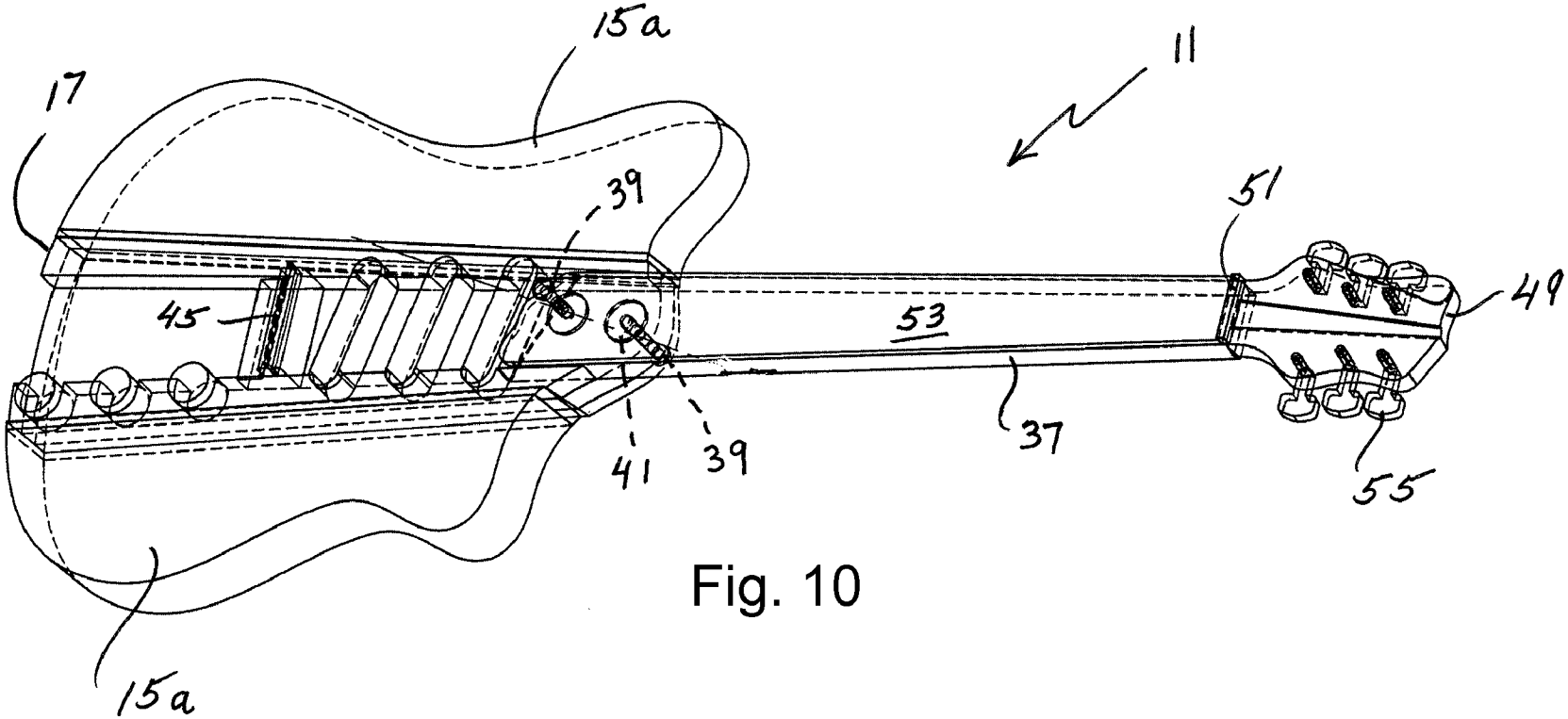
FIG. 10 is a perspective view similar to FIG. 8 which shows components with hidden lines.

As best seen from FIGS. 4, 8, 9 and 10, a neck 37 is fitted into the upper end of the spine 17 and clamped to the internal bottom member 33. In one method of construction, the neck 37 is preferably tightly fitted between the ribs 43 at the upper end of the spine so as to lie flush against the upper surface of the internal bottom number 33 and to lie snug against both ribs 43. The lower end portion of the neck is affixed to the internal bottom member 33 by at least two threaded members, screws or bolts 39 that are received in T-nuts 41 (see FIGS. 3 and 8), i.e. hardware frequently employed to create secure mechanical connections. Although other types of threaded clamping may be employed, it is felt that there are advantages through using machine screws 39 and T-nuts 41 which have circular flange bodies that can be seated in a counterbore recess. The neck 37 is clamped to the internal bottom member 33 at least two longitudinally spaced locations (as seen in FIGS. 8 and 10) which resists any separation as a result of tension in the strings 46, and it is in tight contact with the ribs 43 (to which there may be an adhesive joinder) at its end where there is overlap which positively resists any movement in a lateral plane. The external bottom member 35 may be securely adhesively attached to the undersurface thereof to cover the threaded joinder and complete the composite bottom 29 of the center spine 17. Alternatively, the neck may be first clamped to the bottom 29 before the spine 17 is completed, and the head of a socket head screw may also extend through the external bottom as seen in FIG. 9. The ribs 43 are then snugly fitted to the lateral surfaces of the neck and the upper surface of the bottom 29. In either instance, as can be seen from FIGS. 2 and 6, the result is a bottom wall 29 of the open-top channel having an upper surface that will be parallel to the top surface 21*a* of the proximal wing 15*a*, and a neck which is, in essence, an extension of this bottom wall. In the final construction, the two lateral spine walls 31 are affixed to the side edges of the composite bottom 29 and to the outer lateral surface of each rib 43 as by strong adhesive attachment to complete the spine.

In either instance, the attachment of the wings 15 to the spine 17 may occur anytime thereafter. Although the terms top and bottom walls are used herein, when the wings 15 are solid pieces, these terms should be understood to refer to the surfaces thereof.

A bridge 45 made of wood, plastic or metal may be supported upon the bottom 29 and/or between the two ribs 43, such that it spans the open region at the top of the center spine 17 and provides a base for attachment of the ends of the guitar strings 46; as seen in FIG. 1, the bridge is usually positioned at about a longitudinally central location in the body 13. The shape of the bridge 45 allows it to be affixed to the bottom 29 and both ribs 43 and provides a very secure mounting for the strings 46. In the illustrated embodiment, three electronic pickups 47 are disposed in the open region of the center spine, supported in notches 48 provided in the ribs 43, so as to lie beneath the plurality of guitar strings 46. The strings 46 extend along the length of the neck 37 from the bridge 45 to a headstock 49 at the end of the neck. A nut or zero fret 51 is located at about the junction between the neck 39 and the headstock 49, over which the guitar strings 46 pass and which thus spaces the strings slightly above the top surface of the neck. Usually, a plurality of individual frets (not shown) will be spaced along the neck 37 of the guitar as by being molded into a decorative cover panel 53 that is mounted on the top surface of the neck, as is well-known in this art. The free end of each string 46 is attached to an individual tuner, e.g. an adjustable thumbscrew 55, that is mounted in the headstock 49 as well known in this art.

A plurality of control knobs 57 are located between the bridge 45 and the lower end of the body in this open region of the center spine. They are preferably mounted in recesses 58 provided in one of the ribs 43, e.g. the rib 43*b* and associated electrical circuitry (not shown) is accommodated in the open region of the center spine adjacent the control knobs 57.

Figure 6:
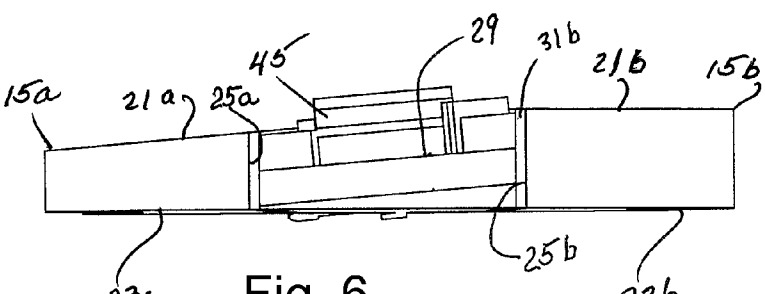
FIG. 6 is an end view, enlarged in size, of the instrument of FIG. 2.

The ergonomic design is such that the guitar 11 will be constructed in both right-handed and left-handed versions. The guitar illustrated in the drawings is a right-handed version; the wing 15*a*, which will lie adjacent to the body of a right-handed player, is referred to as the proximal wing and is of lesser thickness than the distal wing 15*b*. As best seen in FIG. 6, the top surface 21*a* of the thinner, proximal wing 15*a* is oriented so that it lies in a plane that would intersect the top surface 21*b* of the distal wing 15*b* along a line that constitutes the inner edge of the top surface of the distal wing where the top surface 21*b* meets the sidewall 25*b*. It is oriented at an angle of at least about 4 degrees and preferably between about 4 and 7 degrees to the top surface 21*b* of the distal wing. Because the bridge 45 and the neck 37 are similarly oriented (as for example being both mounted on the composite bottom 29), the strings 46 will also lie in a plane which is parallel to this 4 to 7 degree canted plane. Because the canted plane extends toward the face of the player, it facilitates the strumming of the guitar by a right-handed player. This ergonomic accomplishment is the result of the employment of the wings 15 of different thicknesses in combination with the center spine 17 which utilizes lateral or side members 31 of different heights, as can be seen from FIG. 6. The result is the creation of a canted upper surface region of the guitar 11 that lies closer to the player, which surface region extends completely across the proximal wing 15*a* and effectively to the distal wing 15*b*.

The construction of the center spine 17 and the orientation and positioning of the composite bottom member 29 which has an upper surface that is parallel to the top surface 21*a* of the proximal wing 15*a*, facilitates the effective and very firm attachment of the neck 37 to the body of the guitar in a manner which improves the overall tonal quality. Moreover, the open recess accommodates the pickups 47 at locations directly below the strings 46 and provides space for the control knobs 57 and associated circuitry. The result is a unique guitar body assembly which provides a canted surface guitar neck 37 that is attached in a perfect neck-to-body relation which allows for maximum sustain and volume. The central open-top cavity in the guitar body 13 that is provided by this unique center spine 17 expands volume and tonal potential; moreover, it allows the bridge block 45 to extend downward so that it is essentially mounted in the same plane as the neck. The result is a unique guitar body having an overall shape which is ergonomic, i.e. the major surface area of its top surface lying in an plane that angles toward the body of the player, and as a result, the plane of the strings 46 is shifted toward the face of the player. This eliminates the common discomforts that would often tend to interfere with the player's ability to easily strum the instrument by providing an instrument that affords a most comfortable orientation for performing.

In summary, the combination produces a guitar 11 having an ergonomic upper surface that shifts the plane of the strings 46 toward the player, which incorporates a unique body 13 having an open-top center channel extending longitudinally through the body. This open channel provides an excellent platform for the very firm attachment of the neck 37 to the body through the bottom composite wall 29 and the ribs 43 of the center spine 17 that effects the desired canted surface of the neck while also resulting in unexpected tonal advantages.

Although the invention has been described with regard to certain preferred embodiments which constitute what the inventor believes to be the best mode for carrying out his invention, it should be understood that various changes and modifications, as would be obvious to one having ordinary skill in the art, may be made without departing from the scope of the invention, which is defined by the claims appended hereto. Particular features of the invention are emphasized in the claims which follow.

The invention claimed is:

1. An electric guitar which comprises:

a body having an upper end and a lower end and which is assembled from a center spine and a pair of wings, each wing having a top wall, a bottom wall, a sidewall and a peripheral wall, and each said wing being affixed at its respective inner wall to said center spine so as to flank same on opposite lateral sides thereof, and a neck attached to said body and extending longitudinally therefrom, said wings comprising a proximal wing that will reside adjacent the body of the player and a distal wing, and said proximal wing having a height that is less than the height of said distal wing as a part of an overall construction that shifts the plane of strings that extend along said neck toward the face of the player.

2. The guitar according to claim 1 wherein said proximal wing has a flat bottom wall, and a planar top wall that is canted at an angle between about 4° and about 7° with respect to said flat bottom wall and wherein a flat top surface of said neck is essentially parallel to said top wall of said proximal wing.

3. The guitar according to claim 2 wherein said center spine comprises two flat lateral spine members extending longitudinally of said body and a bottom wall that is affixed to lower edge regions of said two lateral spine members so as to create an open region therebetween that provides a longitudinally extending open recess in a top surface of the guitar body.

4. The guitar according to claim 3 wherein said neck is connected to said bottom wall of said center spine at the upper end of said body and extends longitudinally away from said body to a headstock at the end of the neck and wherein said neck has a flat top surface.

5. The guitar according to claim 4 wherein said neck flap top surface is aligned so as to be essentially coplanar with said top wall of said proximal wing and said neck is rigidly attached to said bottom wall of said spine by threaded connected members.

6. The guitar according to claim 5 wherein a bridge is mounted in said recess at a generally longitudinally central region of said recess and is aligned so as to be essentially parallel to said flat top surface of said neck, and wherein a plurality of strings extend longitudinally along said neck from said bridge to a zero fret mounted on said neck, said strings lying in a plane essentially parallel to said top wall of said proximal wing.

7. The guitar according to claim 6 wherein said distal wing has parallel top and bottom flat walls and said top wall of said proximal wing lies in a plane that intersects the plane of the top wall of said distal wing at about a top edge of said inner wall of said distal wing.

8. The guitar according to claim 6 which is an electric guitar wherein one or more pickups are mounted in said open recess of said spine at a location below said strings.

9. The guitar according to claim 8 wherein said bottom wall of said spine has an upper surface that is aligned essentially parallel to the plane of said strings, to which last-mentioned surface said neck is rigidly affixed.

10. The guitar according to claim 9 wherein one or more control knobs are mounted in said longitudinal open recess in a region between said bridge and the lower end of said spine.

11. A guitar which comprises:

a body and a neck extending longitudinally from an upper end of said body, said body having a flat bottom wall and a top wall that includes (a) a proximal section which would lie closer to the person playing the guitar and (b) a distal section lying beyond said proximal section, said proximal section of said top wall lying in a plane oriented at an angle at least about 4 degrees to the plane of said distal section, and said neck having a top surface that is essentially parallel to the proximal section of said top wall so that the plane of strings that will extend longitudinally along said neck is shifted toward the face of the player.

12. The guitar according to claim 11, wherein a bridge is mounted on said body and a zero fret is mounted on said neck, both of which are aligned essentially parallel to said proximal section of said top wall which is flat and wherein a plurality of strings extend between said bridge and said zero fret and, in the region therebetween, said strings lie spaced above the top surface of said neck in a plane essentially parallel to said flat proximal section of said top wall.

13. A guitar which comprises:

a body, a neck extending longitudinally from an upper end of the body to a headstock at the end thereof, said body having a bottom surface, a peripheral surface and a top surface, which top surface has a planar distal region and a planar proximal region which is oriented at an angle of about 4 to 7 degrees to said distal surface region, and said neck having a top planar surface that is essentially parallel with said planar proximal region, and means for supporting a plurality of strings, which all extend longitudinally along said neck from a central region of said body, so that the supported strings lie in a plane essentially parallel to said proximal surface region, which plane is shifted toward the face of the player.

14. The guitar according to claim 13 wherein said bottom surface is planar and essentially parallel to said distal region of said top surface.

15. The guitar according to claim 14 wherein the remainder of the top surface of said guitar body other than said distal surface region lies either in the plane of said proximal region or is recessed therebelow, said body having an open-top channel along its longitudinal centerline.

16. The guitar according to claim 15 wherein said center spine provides an open-top channel extending longitudinally of said body which spine is longitudinally aligned with said neck.

17. The guitar according to claim 16 wherein said center spine comprises a pair of flat lateral spine members extending longitudinally of said body and a bottom wall that is affixed to lower edge regions of said two lateral spine members so as to create an open region therebetween that provides a longitudinally extending open recess in the top surface of the guitar body.

18. The guitar according to claim 17 wherein said neck has a top surface aligned so as to be essentially parallel with said top surface of said proximal wing and wherein said neck is rigidly attached to said bottom wall of said spine by threaded members.

* * * * *